US010255862B2

(12) United States Patent
Shi

(10) Patent No.: US 10,255,862 B2
(45) Date of Patent: Apr. 9, 2019

(54) DRIVING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Longqiang Shi, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 88 days.

(21) Appl. No.: 15/544,017

(22) PCT Filed: Apr. 28, 2017

(86) PCT No.: PCT/CN2017/082628
§ 371 (c)(1),
(2) Date: Jul. 16, 2017

(87) PCT Pub. No.: WO2018/176555
PCT Pub. Date: Oct. 4, 2018

(65) Prior Publication Data

US 2018/0336845 A1 Nov. 22, 2018

(30) Foreign Application Priority Data

Mar. 31, 2017 (CN) ..... 2017 1 0208517

(51) Int. Cl.
*G09G 3/34* (2006.01)
*G09G 3/36* (2006.01)
(Continued)

(52) U.S. Cl.
CPC ..... *G09G 3/3406* (2013.01); *G09G 3/3225* (2013.01); *G09G 3/3233* (2013.01); *G09G 3/3648* (2013.01); *G09G 2320/0233* (2013.01)

(58) Field of Classification Search
CPC .... G09G 3/3225; G09G 3/3233; G09G 3/325; G09G 3/3258; G09G 3/34; G09G 3/3406;
(Continued)

(56) References Cited

U.S. PATENT DOCUMENTS 6,229,506 B1 5/2001 Dawson et al.
7,864,141 B2 * 1/2011 Goh ..... G09G 3/3233 313/504

(Continued)

FOREIGN PATENT DOCUMENTS

CN 103035201 A 4/2013
CN 104658483 A 5/2015

(Continued)

*Primary Examiner* — Vijay Shankar
(74) *Attorney, Agent, or Firm* — Andrew C. Cheng

(57) ABSTRACT

Disclosed is a driving circuit, comprising first to fourth electrical switches, a driving electrical switch and capacitor. The control end and second end of the first switch are coupled to a driving scan line and second end of the driving switch. The control end, first end and second end of the driving switch are coupled to the capacitor, a second end of the second switch and a first end of the fourth switch. A control end of the second switch is coupled to the driving scan line. The control end of the third switch respectively is coupled to a first compensation scan line and receives a direct current voltage. The control end and second end of the fourth switch are coupled to a compensation scan line and an anode of an organic light emitting diode. The capacitor is coupled to a cathode of the organic light emitting diode and grounded.

8 Claims, 2 Drawing Sheets

(51) Int. Cl.
*G09G 3/3225* (2016.01)
*G09G 3/3233* (2016.01)

(58) Field of Classification Search
CPC . G09G 3/36; G09G 3/3648; G09G 2320/0233
See application file for complete search history.

(56) References Cited

U.S. PATENT DOCUMENTS

| | | | | |
|---|---|---|---|---|
| 9,595,227 | B2 * | 3/2017 | Yang | G09G 3/3233 |
| 2016/0189610 | A1 * | 6/2016 | Xiao | G09G 3/3233<br>345/77 |
| 2016/0240139 | A1 * | 8/2016 | Yang | G09G 3/3233 |

FOREIGN PATENT DOCUMENTS

| | | | |
|---|---|---|---|
| CN | 105096826 | A | 11/2015 |
| CN | 106205486 | A | 12/2016 |
| CN | 106504703 | A | 3/2017 |

* cited by examiner

DRIVING CIRCUIT AND LIQUID CRYSTAL DISPLAY DEVICE

CROSS REFERENCE

This application claims the priority of Chinese Patent Application No. 201710208517.3, entitled "Driving circuit and liquid crystal display device", filed on Mar. 31, 2017, the disclosure of which is incorporated herein by reference in its entirety.

FIELD OF THE INVENTION

The present invention relates to a display technology field, and more particularly to a driving circuit and a liquid crystal display device.

BACKGROUND OF THE INVENTION

A traditional organic light emitting diode driving circuit comprises two thin film transistors and a storage capacitor. One thin film transistor is a switching thin film transistor and the other thin film transistor is a driving thin film transistor. After driving for a long period of time, the threshold voltage of the driving thin film transistor drifts due to the long-term voltage application. The change in the threshold voltage of the driving thin film transistor will inevitably cause a change in the output current of the driving thin film transistor. Since the driving thin film transistor is coupled to the organic light emitting diode to drive the organic light emitting diode to emit light. The change in the output current of the driving thin film transistor will inevitably cause a change in the brightness of the organic light emitting diode, thus influencing the normal display of the organic light emitting diode.

SUMMARY OF THE INVENTION

An objective of the present invention is to provide a driving circuit to keep the brightness of the organic light emitting diode constant for maintaining the normal display of the liquid crystal display device.

Another objective of the present invention is to provide a liquid crystal display device.

For realizing the aforesaid objective, the technical solution provided by the embodiments of the present invention is:

The present invention provides a driving circuit, applied in a liquid crystal display device for driving an organic light emitting diode to emit light, wherein the driving circuit comprises a first electrical switch, a second electrical switch, a third electrical switch, a fourth electrical switch, a driving electrical switch and a capacitor, wherein a control end of the first electrical switch is coupled to a driving scan line, a first end of the first electrical switch receives a data signal, a second end of the first electrical switch is coupled to a second end of the driving electrical switch, wherein a control end of the driving electrical switch is coupled to a first end of the capacitor and coupled to a first end of the second electrical switch, a first end of the driving electrical switch is coupled to a second end of the second electrical switch and coupled to a second end of the third electrical switch, the second end of the driving electrical switch is coupled to a second end of the fourth electrical switch, wherein a control end of the second electrical switch is coupled to the driving scan line, wherein a control end of the third electrical switch is coupled to a compensation scan line, a first end of the third electrical switch receives a direct current voltage, wherein a control end of the fourth electrical switch is coupled to the compensation scan line, a second end of the fourth electrical switch is coupled to an anode of the organic light emitting diode, wherein a second end of the capacitor is coupled to a cathode of the organic light emitting diode and grounded, wherein as the driving scan line outputs a high voltage level, the compensation scan line outputs a low voltage level.

The driving scan line is a nth stage driving scan line, the compensation scan line and the driving scan line are scan lines of the same stage, wherein the driving circuit further comprises a n−1th stage driving scan line and a fifth electrical switch, a control end of the fifth electrical switch is coupled to the n−1th stage driving scan line, a first end of the fifth electrical switch is coupled to the direct current voltage, a second end of the fifth electrical switch is coupled to the control end of the driving electrical switch, wherein as the n−1th stage driving scan line outputs a high voltage level, the compensation scan line outputs a low voltage level.

The driving circuit further comprises a row driver and a column driver, the first end of the first electrical switch is coupled to the column driver to receive the data signal outputted by the column driver, the row driver outputs control signals to the n−1th stage driving scan line, the nth stage driving scan line and the nth compensation scan line.

The first to fifth electrical switches and the driving electrical switch are all NPN type field effect transistors, the control ends, the first ends and the second ends of the first to fifth electrical switches and the driving electrical switch respectively are gates, drains and sources.

The first to fifth electrical switches and the driving electrical switch are all indium gallium zinc oxide thin film transistors.

The present invention further provides a liquid crystal display device, comprising an organic light emitting diode and a driving circuit, for driving the organic light emitting diode to emit light, wherein the driving circuit comprises a first electrical switch, a second electrical switch, a third electrical switch, a fourth electrical switch, a driving electrical switch and a capacitor, wherein a control end of the first electrical switch is coupled to a driving scan line, a first end of the first electrical switch receives a data signal, a second end of the first electrical switch is coupled to a second end of the driving electrical switch, wherein a control end of the driving electrical switch is coupled to a first end of the capacitor and coupled to a first end of the second electrical switch, a first end of the driving electrical switch is coupled to a second end of the second electrical switch and coupled to a second end of the third electrical switch, the second end of the driving electrical switch is coupled to a second end of the fourth electrical switch, wherein a control end of the second electrical switch is coupled to the driving scan line, wherein a control end of the third electrical switch is coupled to a compensation scan line, a first end of the third electrical switch receives a direct current voltage, wherein a control end of the fourth electrical switch is coupled to the compensation scan line, a second end of the fourth electrical switch is coupled to an anode of the organic light emitting diode, wherein a second end of the capacitor is coupled to a cathode of the organic light emitting diode and grounded, wherein as the driving scan line outputs a high voltage level, the compensation scan line outputs a low voltage level.

The driving scan line is a nth stage driving scan line, the compensation scan line and the driving scan line are scan lines of the same stage, wherein the driving circuit further comprises a n−1th stage driving scan line and a fifth electrical switch, a control end of the fifth electrical switch is coupled to the n−1th stage driving scan line, a first end of the fifth electrical switch is coupled to the direct current voltage, a second end of the fifth electrical switch is coupled to the control end of the driving electrical switch, wherein as the n−1th stage driving scan line outputs a high voltage level, the compensation scan line outputs a low voltage level.

The driving circuit further comprises a row driver and a column driver, the first end of the first electrical switch is coupled to the column driver to receive the data signal outputted by the column driver, the row driver outputs control signals to the n−1th stage driving scan line, the nth stage driving scan line and the nth compensation scan line.

The first to fifth electrical switches and the driving electrical switch are all NPN type field effect transistors, the control ends, the first ends and the second ends of the first to fifth electrical switches and the driving electrical switch respectively are gates, drains and sources.

The first to fifth electrical switches and the driving electrical switch are all indium gallium zinc oxide thin film transistors.

The embodiments of the present invention have advantages or benefits:

the driving circuit of the present invention is applied in a liquid crystal display device for driving an organic light emitting diode to emit light, wherein the driving circuit comprises a first electrical switch, a second electrical switch, a third electrical switch, a fourth electrical switch, a driving electrical switch and a capacitor, wherein a control end of the first electrical switch is coupled to a driving scan line, a first end of the first electrical switch receives a data signal, a second end of the first electrical switch is coupled to a second end of the driving electrical switch, wherein a control end of the driving electrical switch is coupled to a first end of the capacitor and coupled to a first end of the second electrical switch, a first end of the driving electrical switch is coupled to a second end of the second electrical switch and coupled to a second end of the third electrical switch, the second end of the driving electrical switch is coupled to a second end of the fourth electrical switch, wherein a control end of the second electrical switch is coupled to the driving scan line, wherein a control end of the third electrical switch is coupled to a compensation scan line, a first end of the third electrical switch receives a direct current voltage, wherein a control end of the fourth electrical switch is coupled to the compensation scan line, a second end of the fourth electrical switch is coupled to an anode of the organic light emitting diode, wherein a second end of the capacitor is coupled to a cathode of the organic light emitting diode and grounded, wherein as the driving scan line outputs a high voltage level, the compensation scan line outputs a low voltage level. The first electrical switch, the second electrical switch and the driving electrical switch are turned on so that the driving electrical switch is constantly turned on. As driving, the compensation scan line is at a high voltage level. The third electrical switch and the fourth electrical switch are turned on and the first electrical switch and the second electrical switch are turned off so that the current of the driving electrical switch is related with the data signal and the direct current voltage for keeping the current of the driving electrical switch constant and the brightness of the organic light emitting diode unchanged to maintain the normal display of the liquid crystal display device.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

Figure 1:
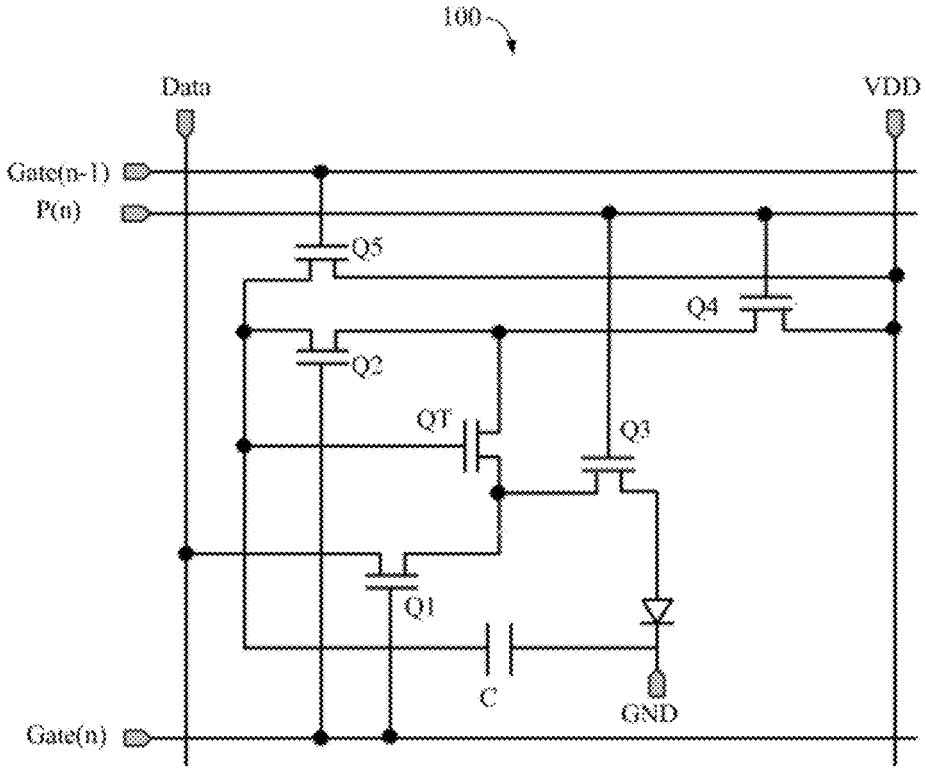
FIG. 1 is a circuit diagram of a driving circuit provided by the first embodiment of the present invention.

Please refer to FIG. 1. The first embodiment of the present invention provides a driving circuit 100. The driving circuit 100 is applied in a liquid crystal display device for driving an organic light emitting diode to emit light. The driving circuit 100 comprises a first electrical switch Q1, a second electrical switch Q2, a third electrical switch Q3, a fourth electrical switch Q4, a driving electrical switch QT and a capacitor C. A control end of the first electrical switch Q1 is coupled to a driving scan line Gate(n), a first end of the first electrical switch Q1 receives a data signal, a second end of the first electrical switch Q1 is coupled to a second end of the driving electrical switch QT, wherein a control end of the driving electrical switch QT is coupled to a first end of the capacitor C and coupled to a first end of the second electrical switch Q2, a first end of the driving electrical switch QT is coupled to a second end of the second electrical switch Q2 and coupled to a second end of the third electrical switch Q3, the second end of the driving electrical switch QT is coupled to a second end of the fourth electrical switch Q4, wherein a control end of the second electrical switch Q2 is coupled to the driving scan line Gate(n), wherein a control end of the third electrical switch Q3 is coupled to a compensation scan line P(n), a first end of the third electrical switch Q3 receives a direct current voltage VDD, wherein a control end of the fourth electrical switch Q4 is coupled to the compensation scan line P(n), a second end of the fourth electrical switch Q4 is coupled to an anode of the organic light emitting diode, wherein a second end of the capacitor C is coupled to a cathode of the organic light emitting diode and grounded, wherein as the driving scan line Gate(n) outputs a high voltage level, the compensation scan line P(n) outputs a low voltage level.

In this embodiment, the first to fourth electrical switches Q1-Q4 and the driving electrical switch QT are all IGZO (indium gallium zinc oxide) thin film transistors. The first to fourth electrical switches and the driving electrical switch are all NPN type field effect transistors, the control ends, the first ends and the second ends of the first to fourth electrical switches and the driving electrical switch respectively are gates, drains and sources. In other embodiments, the first to fourth electrical switches Q1-Q4 and the driving electrical switch QT can also be thin film transistors of other materials depending on actual needs. The first to fourth electrical switches Q1-Q4 and the driving electrical switch QT can also be thin film transistors of other types depending on actual needs.

Figure 2:
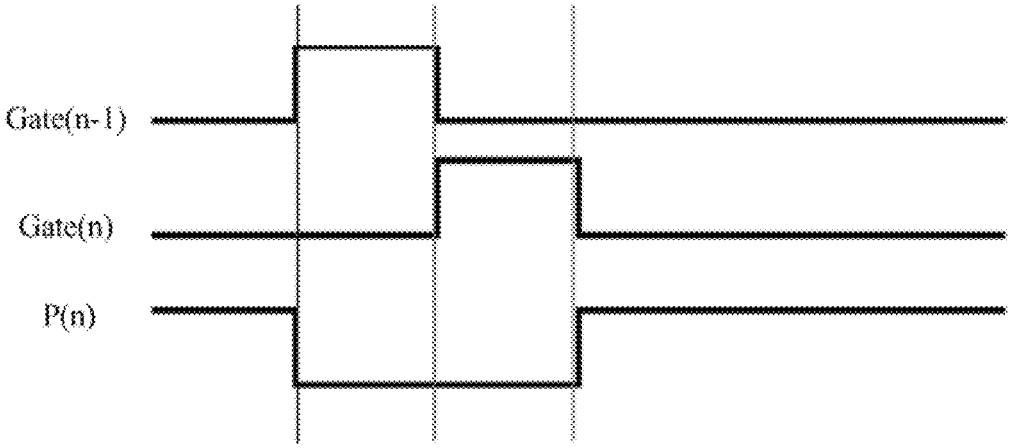
FIG. 2 is a signal sequence diagram of the driving circuit in FIG. 1.

Please continue referring to FIG. 2. When the driving scan line Gate(n) is at a high voltage level, the second electrical switch Q2, the driving electrical switch QT and the first electrical switch Q1 are turned on. The first end and the control end of the driving electrical switch QT are shorted to form a diode. Meanwhile, the data signal Vdata is written into the second end of the driving electrical switch QT. The voltage of the first end of the driving electrical switch QT is Vdata+Vth, wherein Vth is a threshold voltage of the driving electrical switch QT.

Since the control end of the driving electrical switch QT and the first end of the driving electrical switch QT are shorted, the voltage of the control end of the driving electrical switch QT is Vdata+Vth. Namely, the threshold voltage Vth and the inputted data signal Vdata of the driving electrical switch QT are stored in one end of the capacitor C at one side of the driving electrical switch QT.

Since the compensation scan line P(n) and the driving scan line Gate(n−1) of the former stage are at a low voltage level, the third electrical switch Q3 and the fourth electrical switch Q4 are turned off and do not influence the condition that the driving electrical switch QT is constantly turned on. As driving, the compensation scan line P(n) is at a high voltage level.

The third electrical switch Q3 and the fourth electrical switch Q4 are turned on. The first electrical switch Q1 and the second electrical switch Q2 are turned off. The driving electrical switch QT is turned on. A current formula of the driving electric switch QT:

$$Ids=\beta/2(Vgs-Vth)^2=\beta/2(Vg-Vs-Vth)^2=\beta/2(V\text{data}+Vth-Vs-Vth)^2=\beta/2(V\text{data}-Vs)^2.$$

Specifically, Vg is a voltage of a gate of the driving electric switch QT; Vs is a voltage of a source of the driving electric switch QT; Vgs is a voltage between the gate and the source of the driving electric switch QT. Since the third electrical switch Q3 and the fourth electrical switch Q4 are turned on, the voltage of the source of the driving electric switch QT is equal to the direct current voltage. Accordingly, $Ids=\beta/2(Vgs-Vth)^2=\beta/2(Vg-Vs-Vth)^2=\beta/2(Vdata+Vth-Vs-Vth)^2=\beta/2(Vdata-Vs)^2=\beta/2(V\ data-VDD)^2$ and VDD is the direct current voltage.

Since the data signal Vdata and the direct current voltage VDD are both fixed values. The current Ids of the driving electric switch QT is fixed and the brightness of the organic light emitting diode is constant so that the liquid crystal display device utilizing the driving circuit 100 can normally display.

Furthermore, the driving scan line Gate(n) is a nth stage driving scan line. The driving circuit 100 further comprises a n−1th stage driving scan line Gate(n−1) and a fifth electrical switch Q5. A control end of the fifth electrical switch Q5 is coupled to the n−1th stage driving scan line Gate(n−1). A first end of the fifth electrical switch Q5 is coupled to the direct current voltage VDD. A second end of the fifth electrical switch Q5 is coupled to the control end of the driving electrical switch QT. As the n−1th stage driving scan line Gate(n−1) outputs a high voltage level, the compensation scan line P(n) outputs a low voltage level.

Specifically, the driver controls the n−1th stage driving scan line Gate(n−1) to be at a high voltage level, the fifth electrical switch Q5 and the driving electrical switch QT are turned on. Then, the nth stage driving scan line Gate(n) and the compensation scan line P(n) are at low voltage level and the first to fourth electrical switches Q1-Q3 are turned off. The control end of the driving electrical switch QT is coupled to the direct current voltage VDD to accomplish the initialization of the driving electrical switch QT for removing the residual charge.

Furthermore, the driving circuit 100 further comprises a row driver and a column driver. The first end of the first electrical switch Q1 is coupled to the column driver to receive the data signal VDD outputted by the column driver. The row driver outputs control signals to the n−1th stage driving scan line Gate(n−1), the nth stage driving scan line Gate(n) and the compensation scan line P(n).

Figure 3:
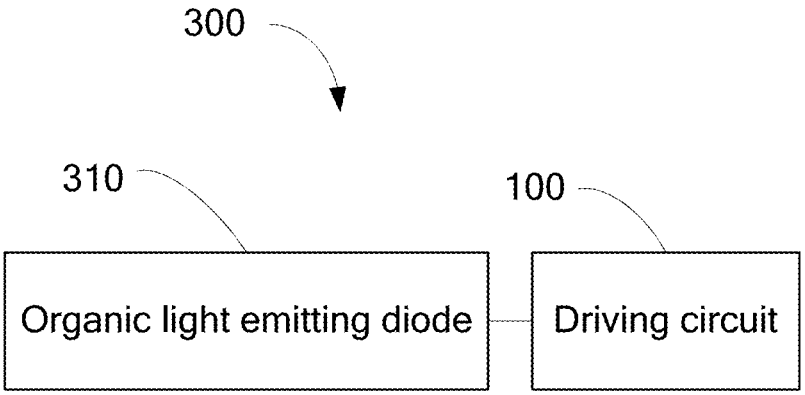
FIG. 3 is a block diagram of a liquid crystal display device provided by the second embodiment of the present invention.

Please refer to FIG. 3. The second embodiment of the present invention provides a liquid crystal display device 300. The liquid crystal display device 300 comprises an organic light emitting diode 310 and a driving circuit. The driving circuit is used to drive the organic light emitting diode 310 to emit light. In this embodiment, the driving circuit can be the driving circuit 100 in the foregoing first embodiment. The driving circuit 100 has already been described in detail in the aforesaid first embodiment. The repeated description is omitted here.

In this embodiment, the liquid crystal display device 300 comprises the driving circuit 100. The driving circuit 100 comprises a first electrical switch Q1, a second electrical switch Q2, a third electrical switch Q3, a fourth electrical switch Q4, a driving electrical switch QT and a capacitor C. A control end of the first electrical switch Q1 is coupled to a driving scan line Gate(n), a first end of the first electrical switch Q1 receives a data signal, a second end of the first electrical switch Q1 is coupled to a second end of the driving electrical switch QT, wherein a control end of the driving electrical switch QT is coupled to a first end of the capacitor C and coupled to a first end of the second electrical switch Q2, a first end of the driving electrical switch QT is coupled to a second end of the second electrical switch Q2 and coupled to a second end of the third electrical switch Q3, the second end of the driving electrical switch QT is coupled to a second end of the fourth electrical switch Q4, wherein a control end of the second electrical switch Q2 is coupled to the driving scan line Gate(n), wherein a control end of the third electrical switch Q3 is coupled to a compensation scan line P(n), a first end of the third electrical switch Q3 receives a direct current voltage VDD, wherein a control end of the fourth electrical switch Q4 is coupled to the compensation scan line P(n), a second end of the fourth electrical switch Q4 is coupled to an anode of the organic light emitting diode, wherein a second end of the capacitor C is coupled to a cathode of the organic light emitting diode and grounded, wherein as the driving scan line Gate(n) outputs a high voltage level, the compensation scan line P(n) outputs a low voltage level.

When the driving scan line Gate(n) is at a high voltage level, the second electrical switch Q2, the driving electrical switch QT and the first electrical switch Q1 are turned on. The first end and the control end of the driving electrical switch QT are shorted to form a diode. Meanwhile, the data signal Vdata is written into the second end of the driving electrical switch QT. The voltage of the first end of the driving electrical switch QT is Vdata+Vth, wherein Vth is a threshold voltage of the driving electrical switch QT.

Since the control end of the driving electrical switch QT and the first end of the driving electrical switch QT are shorted, the voltage of the control end of the driving electrical switch QT is Vdata+Vth. Namely, the threshold voltage Vth and the inputted data signal Vdata of the driving electrical switch QT are stored in one end of the capacitor C at one side of the driving electrical switch QT.

Since the compensation scan line P(n) and the driving scan line Gate(n−1) of the former stage are at a low voltage level, the third electrical switch Q3 and the fourth electrical switch Q4 are turned off and do not influence the condition that the driving electrical switch QT is constantly turned on.

As driving, the compensation scan line P(n) is at a high voltage level. The third electrical switch Q3 and the fourth electrical switch Q4 are turned on. The first electrical switch Q1 and the second electrical switch Q2 are turned off. The driving electrical switch QT is turned on. A current formula of the driving electric switch QT:

$$Ids=\beta/2(Vgs-Vth)^2=\beta/2(Vg-Vs-Vth)^2=\beta/2(V\text{data}+Vth-Vs-Vth)^2=\beta/2(V\text{data}-Vs)^2.$$

Specifically, Vg is a voltage of a gate of the driving electric switch QT; Vs is a voltage of a source of the driving electric switch QT; Vgs is a voltage between the gate and the source of the driving electric switch QT. Since the third electrical switch Q3 and the fourth electrical switch Q4 are turned on, the voltage of the source of the driving electric switch QT is equal to the direct current voltage. Accordingly, $Ids=\beta/2(Vgs-Vth)^2=\beta/2(Vg-Vs-Vth)^2=\beta/2(Vdata+Vth-Vs-Vth)^2=\beta/2(Vdata-Vs)^2=\beta/2(V\ data-VDD)^2$ and VDD is the direct current voltage.

Since the data signal Vdata and the direct current voltage VDD are both fixed values. The current Ids of the driving electric switch QT is fixed and the brightness of the organic light emitting diode is constant so that the liquid crystal display device utilizing the driving circuit 300 can normally display.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal display device, comprising an organic light emitting diode and a driving circuit, for driving the organic light emitting diode to emit light, wherein the driving circuit comprises a first electrical switch, a second electrical switch, a third electrical switch, a fourth electrical switch, a driving electrical switch and a capacitor, wherein a control end of the first electrical switch is coupled to a driving scan line, a first end of the first electrical switch receives a data signal, a second end of the first electrical switch is coupled to a second end of the driving electrical switch, wherein a control end of the driving electrical switch is coupled to a first end of the capacitor and coupled to a first end of the second electrical switch, a first end of the driving electrical switch is coupled to a second end of the second electrical switch and coupled to a second end of the third electrical switch, the second end of the driving electrical switch is coupled to a second end of the fourth electrical switch, wherein a control end of the second electrical switch is coupled to the driving scan line, wherein a control end of the third electrical switch is coupled to a compensation scan line, a first end of the third electrical switch receives a direct current voltage, wherein a control end of the fourth electrical switch is coupled to the compensation scan line, a second end of the fourth electrical switch is coupled to an anode of the organic light emitting diode, wherein a second end of the capacitor is coupled to a cathode of the organic light emitting diode and grounded, wherein as the driving scan line outputs a high voltage level, the compensation scan line outputs a low voltage level, wherein the driving scan line is a nth stage driving scan line, the compensation scan line and the driving scan line are scan lines of the same stage, wherein the driving circuit further comprises a n-1th stage driving scan line and a fifth electrical switch, a control end of the fifth electrical switch is coupled to the n-1th stage driving scan line, a first end of the fifth electrical switch is coupled to the direct current voltage, a second end of the fifth electrical switch is coupled to the control end of the driving electrical switch, wherein as the n-1th stage driving scan line outputs a high voltage level, the compensation scan line outputs a low voltage level.

2. The liquid crystal display device according to claim 1, wherein the driving circuit further comprises a row driver and a column driver, the first end of the first electrical switch is coupled to the column driver to receive the data signal outputted by the column driver, the row driver outputs control signals to the n-1th stage driving scan line, the nth stage driving scan line and the nth compensation scan line.

3. The liquid crystal display device according to claim 1, wherein the first to fifth electrical switches and the driving electrical switch are all NPN type field effect transistors, the control ends, the first ends and the second ends of the first to fifth electrical switches and the driving electrical switch respectively are gates, drains and sources.

4. The liquid crystal display device according to claim 3, wherein the first to fifth electrical switches and the driving electrical switch are all indium gallium zinc oxide thin film transistors.

5. A driving circuit, applied in a liquid crystal display device for driving an organic light emitting diode to emit light, wherein the driving circuit comprises a first electrical switch, a second electrical switch, a third electrical switch, a fourth electrical switch, a driving electrical switch and a capacitor, wherein a control end of the first electrical switch is coupled to a driving scan line, a first end of the first electrical switch receives a data signal, a second end of the first electrical switch is coupled to a second end of the driving electrical switch, wherein a control end of the driving electrical switch is coupled to a first end of the capacitor and coupled to a first end of the second electrical switch, a first end of the driving electrical switch is coupled to a second end of the second electrical switch and coupled to a second end of the third electrical switch, the second end of the driving electrical switch is coupled to a second end of the fourth electrical switch, wherein a control end of the second electrical switch is coupled to the driving scan line, wherein a control end of the third electrical switch is coupled to a compensation scan line, a first end of the third electrical switch receives a direct current voltage, wherein a control end of the fourth electrical switch is coupled to the compensation scan line, a second end of the fourth electrical switch is coupled to an anode of the organic light emitting diode, wherein a second end of the capacitor is coupled to a cathode of the organic light emitting diode and grounded, wherein a second end of the capacitor is coupled to a cathode of the organic light emitting diode and grounded, wherein as the driving scan line outputs a high voltage level, the compensation scan line outputs a low voltage level, wherein the driving scan line is a nth stage driving scan line, the compensation scan line and the driving scan line are scan lines of the same stage, wherein the driving circuit further comprises a n-1th stage driving scan line and a fifth electrical switch, a control end of the fifth electrical switch is coupled to the n-1th stage driving scan line, a first end of the fifth electrical switch is coupled to the direct current voltage, a second end of the fifth electrical switch is coupled to the control end of the driving electrical switch, wherein as the n-1th stage driving scan line outputs a high voltage level, the compensation scan line outputs a low voltage level.

6. The driving circuit according to claim 5, wherein the driving circuit further comprises a row driver and a column driver, the first end of the first electrical switch is coupled to the column driver to receive the data signal outputted by the column driver, the row driver outputs control signals to the n-1th stage driving scan line, the nth stage driving scan line and the nth compensation scan line.

7. The driving circuit according to claim 5, wherein the first to fifth electrical switches and the driving electrical switch are all NPN type field effect transistors, the control ends, the first ends and the second ends of the first to fifth electrical switches and the driving electrical switch respectively are gates, drains and sources.

8. The driving circuit according to claim 7, wherein the first to fifth electrical switches and the driving electrical switch are all indium gallium zinc oxide thin film transistors.

* * * * *